United States Patent [19]

Ferry

[11] 4,276,205

[45] Jun. 30, 1981

[54] DETERGENT COMPOSITIONS CONTAINING AMINE OXIDE AND NONIONIC SURFACTANTS AND POLYETHYLENE GLYCOL

[75] Inventor: Merle W. Ferry, Fairfield, Ohio

[73] Assignee: The Procter & Gamble Company, Cincinnati, Ohio

[21] Appl. No.: 117,904

[22] Filed: Feb. 4, 1980

[51] Int. Cl.[3] ..... C11D 3/37

[52] U.S. Cl. ..... 252/528; 252/547

[58] Field of Search ..... 252/547, 528, 174.22

[56] References Cited

U.S. PATENT DOCUMENTS

| | | | |
|---|---|---|---|
| 2,806,001 | 9/1957 | Fong et al. | 252/550 |
| 3,341,459 | 9/1967 | Davis | 252/528 |
| 3,351,557 | 11/1967 | Almstead et al. | 252/106 |
| 3,843,563 | 10/1974 | Davies et al. | 252/547 |
| 4,000,080 | 12/1976 | Bartolotia et al. | 252/99 |

FOREIGN PATENT DOCUMENTS 1007134 3/1977 Canada .

*Primary Examiner*—Harris A. Pitlick

*Attorney, Agent, or Firm*—Donald E. Hasse; Jerry J. Yetter; Richard C. Witte

[57] ABSTRACT

Detergent compositions exhibiting superior detergency in cool or cold water fabric laundering operations comprise an amine oxide surfactant, an ethoxylated alcohol or ethoxylated alkyl phenol nonionic surfactant, and a $C_2$–$C_4$ alkylene oxide condensation product having a molecular weight in the range of from about 2,000 to 40,000. The compositions preferably contain detergent builder materials, especially alkali metal silicates. Also described are cool or cold water laundering processes utilizing the compositions.

37 Claims, No Drawings

DETERGENT COMPOSITIONS CONTAINING AMINE OXIDE AND NONIONIC SURFACTANTS AND POLYETHYLENE GLYCOL

TECHNICAL FIELD

This invention relates to detergent compositions exhibiting superior detergency performance in cool or cold water fabric laundering operations. The compositions herein contain three essential components: an amine oxide surfactant; an ethoxylated alcohol or ethoxylated alkyl phenol nonionic surfactant; and a $C_2$–$C_4$ alkylene oxide condensation product having a molecular weight in the range from about 2,000 to about 40,000.

The compositions provide superior overall cleaning under cold water usage conditions due to improved body soil removal from laundered fabrics and improved whitening of the fabrics caused by more efficient removal of protein/oil films, as well as less redeposition of soils and less dye transfer between fabrics during the laundering operation. Built detergent compositions of the present type also provide excellent particulate soil removal from fabrics.

There has been considerable demand for detergent compositions which provide superior detergency under cool and cold water washing conditions (5° C. to 35° C.) due to the increasing cost of the energy required to heat water for fabric laundering operations. Further, many fabrics should not be washed in hot water to avoid damage to the fabric, fabric shrinkage, etc. Laundering in cool water also results in less wrinkling of the fabrics. Laundering in cool or cold water also diminishes dye transfer between fabrics, thereby making it possible to launder mixed colors without "sorting". Thus, there are many benefits to be obtained from a detergent composition exhibiting superior performance in cold water laundering operations.

BACKGROUND ART

Various detergent compositions known in the art are said to be effective in cool or cold water laundering operations. For example, U.S. Pat. No. 3,351,557, issued Nov. 7, 1967 to Almstead, et al., discloses built liquid detergent emulsions containing nonionic surfactants and a second surfactant which may be either a sultaine, a phosphine oxide or an amide oxide. U.S. Pat. No. 3,341,459, issued Sept. 12, 1967 to Davis, describes built detergent compositions containing certain alkyl polyethoxy amine oxide surfactants. Also U.S. Pat. No. 3,202,714, issued Aug. 24, 1965, and U.S. Pat. No. 3,281,368, issued Oct. 25, 1966, both to Zimmerer, et al., describe detergent compositions containing amine oxide surfactants having particularly-placed hydroxy groups. The pending U.S. patent applications of Leikhim, et al., Ser. No. 083,907, and Kuzel, et al., Ser. No. 083,908, both filed on Oct. 11, 1979, disclose stable liquid detergent compositions said to provide superior detergency under a wide variety of conditions, including cool water laundering conditions.

Also described in the art are detergent compositions separately containing the essential components herein, or containing combinations of these components different from those of the present invention. For example, U.S. Pat. No. 3,843,563, issued Oct. 22, 1974 to Davies, et al., discloses detergent compositions containing a mixed nonionic and amine oxide surfactant system together with alkali metal carbonate builders. U.S. Pat. No. 2,806,001, issued Sept. 10, 1957 to Fong, et al., describes the use of polyethylene glycols in detergent compositions as an antiredeposition agent. Canadian Pat. No. 1,007,134, issued to Heuring, et al., describes detergent compositions said to be particularly effective in removing clay soils from fabrics, containing anionic surfactants, nonionic surfactants, and the alkylene oxide condensation products of the present invention. All of the above published patents and pending patent applications are incorporated herein by reference.

While the essential components of the present invention are known in the art, it has not heretofore been recognized that their combination results in a detergent composition providing superior cleaning performance in cold water fabric laundering operations.

It is thus an object of the present invention to provide detergent compositions exhibiting superior cleaning performance in cool or cold water fabric laundering operations.

It is also an object of the present invention to provide both liquid and spray-dried granular detergent compositions capable of delivering the above-described benefits.

These and other objects are achieved by the compositions of this invention, as hereinafter described.

SUMMARY OF THE INVENTION

The present invention encompasses detergent compositions especially useful for cold-water fabric laundering operations, comprising:

(a) from about 1% to about 50% by weight of an amine oxide surfactant of the formula

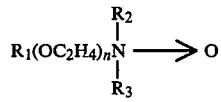

wherein $R_1$ is a $C_{10}$–$C_{18}$ hydrocarbyl or substituted hydrocarbyl lipophilic group, $R_2$ and $R_3$ are each $C_1$–$C_2$ hydrocarbyl or substituted hydrocarbyl groups, and n is from 0 to about 10;

(b) from about 1% to about 75% by weight of an ethoxylated alcohol or ethoxylated alkyl phenol nonionic surfactant of the formula $$R(OC_2H)_nOH$$

wherein R is selected from the group consisting of aliphatic hydrocarbyl groups containing from about 8 to about 18 carbon atoms, alkyl phenyl groups wherein the alkyl group contains from about 8 to about 15 carbon atoms, and mixtures thereof, and n is from about 3 to about 9; and (c) from about 0.1% to about 9% by weight of a $C_2$–$C_4$ alkylene oxide condensation product having an average molecular weight of from about 2,000 to about 40,000, and containing at least 30% by weight of ethylene oxide moieties.

DETAILED DESCRIPTION OF THE INVENTION

This invention relates to the discovery of detergent compositions exhibiting superior detergency in cool or cold water fabric laundering operations. The compositions provide superior overall cleaning under cold water usage conditions due to improved body soil removal from laundered fabrics and improved whitening of the fabrics caused by more efficient removal of protein/oil films, as well as less redeposition of soils and less dye transfer between fabrics during the laundering operation.

While not intending to be limited by theory, it is believed that the amine oxide surfactants herein interact with the fatty acid components of oily soils and lower their melting point so that these soils remain in an at least partially fluidized state even in cold water laundering solutions. These fluidized soils can thus be more effectively "rolled up" and removed by the nonionic surfactants of the present invention. The alkylene oxide condensation product contributes important particulate and oily soil removal benefits. Conventional builders further boost particulate soil removal performance, especially when alkali metal silicates, and preferably also alkali metal carbonates, are used with the compositions to provide an in-use pH in an aqueous laundry liquor of from about 9.0 to about 11.0.

The compositions of the present invention comprise three essential components: an amine oxide surfactant, an ethoxylated alcohol or ethoxylated alkyl phenol nonionic surfactant and an alkylene oxide condensation product, all as hereinafter defined.

Amine Oxide Surfactant

The amine oxide surfactants herein have the formula

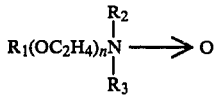

wherein $R_1$ is typically a long-chain (e.g., $C_{10}$–$C_{18}$) hydrocarbyl or substituted hydrocarbyl lipophilic group, $R_2$ and $R_3$ are typically each short-chain (e.g. $C_1$–$C_3$) hydrocarbyl or substituted hydrocarbyl groups, and n is from 0 to about 10.

Suitable amine oxides for use herein are described in U.S. Pat. No. 3,351,557, Almstead, et al., in column 4, lines 46-75. Alkyl polyethoxy amine oxides for use herein are described in U.S. Pat. No. 3,341,459, Davis, particularly from column 1, line 40 through column 2, line 40. Amine oxide surfactants having hydroxy substituents useful herein are described in U.S. Pat. No. 3,202,714, Zimmerer, et al., U.S. Pat. No. 3,441,611, Drew, et al., and in U.S. Pat. No. 3,441,612, Drew.

Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl) dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds. Preferred amine oxides herein are the $C_{12}$–$C_{14}$ dimethylamine oxides. A particularly preferred material is dimethyldodecylamine oxide.

The amine oxide surfactant represents from about 1% to about 50%, preferably from about 1% to 20%, and more preferably from about 3% to about 8%, by weight of the detergent compositions herein.

Nonionic Surfactant

As a second essential component, the compositions herein contain an ethoxylated alcohol or an ethoxylated alkyl phenol nonionic surfactant of the formula $$R(OC_2H_4)_nOH$$

wherein R is selected from the group consisting of aliphatic hydrocarbyl groups containing from about 8 to about 18 carbon atoms, alkenyl phenyl groups wherein the alkyl group contains from about 8 to about 15 carbon atoms, and mixtures thereof, and n is from about 3 to about 9.

Suitable ethoxylated nonionic surfactants are:

1. The polyethylene oxide condensates of alkyl phenols. These compounds include the condensation products of alkyl phenols having an alkyl group containing from about 8 to about 15 carbon atoms, in either a straight chain or branched chain configuration, with ethylene oxide, the ethylene oxide being present in amounts equal to from about 3 to about 9 moles of ethylene oxide per mole of alkyl phenol. The alkyl substituent in such compounds may be derived, for example, from polymerized propylene or isobutylene, or from octene or nonene. Examples of compounds of this type include nonyl phenol condensed with about 9 moles of ethylene oxide per mole of nonyl phenol and dodecyl phenol condensed with about 8 moles of ethylene oxide per mole of dodecyl phenol. Commercially available nonionic surfactants of this type include Igepal CO-610, CA-420, CA-520 and CA-620, marketed by the GAF Corporation, and Triton X-45, X-114, X-100 and X-102, marketed by the Rohm and Haas Company.

2. The condensation products of aliphatic alcohols with ethylene oxide. The alkyl chain of the aliphatic alcohol may either be straight or branched and contains from about 8 to about 18 carbon atoms. Examples of such ethoxylated alcohols include the condensation product of about 5 moles of ethylene oxide with 1 mole of tridecanol, myristyl alcohol condensed with about 8 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with coconut alcohol. Examples of commercially available nonionic surfactants of this type include Tergitol 15-S-7 marketed by the Union Carbide Corporation and Neodol 23-6.5 marketed by the Shell Chemical Company. Whether the alcohol is derived from natural fats or produced by one of several petrochemical processes, a mixture of carbon chain lengths is typical. The stated degree of ethoxylation is an average, the spread being dependent on process conditions, including choice of catalyst.

Ethoxylated alcohols are preferred because of their superior biodegradability relative to ethoxylated alkyl phenols. Particularly preferred are ethoxylated alcohols having an average of from about 10 to about 14 carbon atoms in the alcohol and an average degree of ethoxylation of from about 4 to about 6 moles of ethylene oxide per mole of alcohol.

Preferred anionic surfactants for use herein also include those disclosed in U.S. patent application Ser. No. 001,632, Collins, filed Jan. 8, 1979, incorporated herein by reference. This application describes nonionic surfactants which are base catalyzed primary alcohol ethoxylates which have had the unethoxylated alcohol and monoethoxylated alcohols essentially removed by distillation stripping. The nonionic surfactant consists essentially of a base-catalyzed primary alcohol exthoxylate containing at least 40% by weight of the original alcohol ethoxylate which is formed by reacting a primary alcohol with from about 2 to about 4 moles of ethylene oxide and having the formula $R_4$—$R_5$—$O(CH_2CH_2O)_{nav}H$ wherein $R_4$ is a linear alkyl residue and $R_5$ has the formula $CHR_6CH_2$, $R_6$ being selected from the group consisting of hydrogen and mixtures thereof with $C_1$–$C_4$ alkyl groups, there being not more than 70% by weight of said groups in the mixtures, wherein $R_4$ and $R_5$ together form an alkyl residue containing a mean of 9 to 15 carbon atoms, at least 65% by weight of said residue having a chain length within ±1 carbon atoms of the mean, wherein $3.5<n_{av}<6.5$, provided that the total amount by weight of ethoxylate components in which n=0 shall be not greater than 5% and the total amount by weight of components in which n=2 to 7 inclusive shall be not less than 63%, and wherein the hydrophilic-lipophilic balance (HLB) of the ethoxylate shall lie in the range 9.5 to 11.5, said composition being otherwise free of alkoxylated nonionic surfactants.

The preferred ethoxylated nonionic surfactants herein have HLB (hydrophile-lipophile balance) values of from about 10 to about 13 and limited water solubility. The HLB value of surfactants and emulsifiers can be determined experimentally in a well known fashion. The HLB value of compounds or mixtures of compounds in which the hydrophilic portion of the molecule is principally ethylene oxide can be estimated by the weight ratio of ethylene oxide portion to the liphophilic portion (e.g., the hydrocarbyl radical).

The nonionic surfactant represents from about 1% to about 75%, preferably from about 2% to about 25%, and more preferably from about 5% to about 15%, by weight of the present detergent compositions. Preferably, the weight ratio of nonionic surfactant to amine oxide surfactant is from about 1:4 to about 4:1, more preferably from about 1:1 to about 2:1.

Alkylene Oxide Condensation Product

The third essential component of the present compositions is a $C_2$–$C_4$ alkylene oxide condensation product having an average molecular weight which is from about 2,000 to about 40,000, and containing at least 30% by weight of ethylene oxide moieties. The alkylene oxide condensation product can be represented by homopolymeric condensation products as well as by copolymers of alkylene oxide monomers with different carbon chain lengths. The monomers can include ethylene oxide, propylene oxide and butylene oxide. Suitable for use in the compositions of this invention are copolymers of ethylene and propylene oxides in varying molar ratios. These copolymers are old in the art and have been used for various purposes. The preferred copolymeric alkylene oxide condensation products are a class of materials sold by Wyandotte Chemicals under the tradename PLURONICS.

The PLURONICS are copolymers of polyoxypropylene and polyoxyethylene glycols wherein the polyoxyethylene groups are added to both sides of a polyoxypropylene chain, wherein the latter constitutes the hydrophobic nucleus. (See also U.S. Pat. No. 2,674,619). The oxyethylenic hydrophilic groups can be controlled in length and constitute at least 30% of the final molecule. Preferred PLURONIC species for use in the instant compositions are identified as F108; F98; F88; F68; F87; F77; P105; P85; P75; P65; P104; P94; P84; L64 and P103. The letter identifies the physical form: L for liquids; P for pastes; and F for solid forms hard enough to be flaked. The molecular weight of these preferred copolymeric PLURONIC species suitable for use in the compositions of this invention can easily be calculated based upon trade information freely available. As an example, F108 has a molecular weight of around 16,000; F87 of around 7,500; P85 of around 4,500; and L64 of around 3,000. The preferred molecular weight range of copolymers on basis of ethylene oxide and propylene oxide is from about 2,500 to about 20,000.

Highly preferred for use in the compositions of this invention are polyethylene glycols which, in fact, are homopolymers of ethylene oxide and having the generalized formula $$HO(CH_2CH_2O)_nH$$

n representing the average number of oxyethylene groups. Such compounds have a molecular weight in the range of from about 2,000 to about 40,000, preferably from about 2,500 to about 20,000. These compounds are well known and have been used in various industrial applications. The polyethylene glycols are available under a variety of commercial names. A very well-known commercial name is CARBOWAX, followed by a number that roughly represents the average molecular weight, i.e. CARBOWAX 4,000 represents a polymeric ethylene glycol having an average molecular weight of around 4,000. CARBOWAX is manufactured by the Union Carbide Company. The polyethylene glycols known under the trade denomination "DOW-polyethylene glycols" manufactured by Dow Chemical Company and "Jefferson polyethylene glycols" manufactured by Jefferson Chemical Corp., Inc. having a molecular weight from about 2,000 to about 40,000, preferably from about 2,500 to about 20,000, are additional examples of the highly preferred alkylene oxide polymers used in the instant compositions.

The required level of the alkylene oxide condensation product is from about 0.1% to about 9% of the composition, preferably from about 0.5% to about 6%, and more preferably from about 0.9% to about 4%. Use of the alkylene oxide condensation product above 9% does not produce any noticeable additional particulate soil removal benefit, and for this reason is avoided.

The detergent compositions herein may be solid compositions, for example, granules or or powders, semi-solid pastes or gel compositions, or they may be liquids. The preparation of stable liquid detergent compositions which can be modified to contain the essential components herein is described in the pending U.S. Patent Applications of Leikhim, et al., Ser. No. 083,907, and Kuzel, et al., Ser. No. 083,908, both filed on Oct. 11, 1979, the disclosures of which are incorporated herein by reference. However, the compositions herein are preferably granular detergent compositions formed by admixing the alkylene oxide condensation product with detergent granules formed by spray-drying aqueous slurries of the amine oxide and nonionic surfactants, preferably also containing the optional detergent components described hereinafter.

Optional Components

The detergent compositions herein optionally, but preferably, also contain detergent builder materials. Detergency builders are generally characterized by an ability to sequester or precipitate water hardness ions, particularly calcium and magnesium. They may also be used to maintain or assist in maintaining an alkaline pH in a washing solution.

All manner of detergency builders commonly taught for use in detergent compositions are suitable for use herein. Useful builders include any of the conventional inorganic and organic water-soluble builder salts.

Such detergency builders can be, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference.

Non-phosphorus containing sequestrants can also be selected for use herein as detergency builder.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Other suitable polycarboxylates for use herein are the polyacetal carboxylates fully described in U.S. Pat. 4,144,226, issued Mar. 13, 1979 to Crutchfield, et al., and U.S. Pat. 4,146,495, issued Mar. 27, 1979 to Crutchfield, et al., the disclosures of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Highly preferred non-phosphorus builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate phloroglucinol trisulfonate, and the copolymer of maleic anhydride with vinyl methyl ether or ethylene.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in Belgian Pat. No. 798,856 issued Oct. 29, 1973, the disclosure of which is incorporated herein by reference.

Specific examples of such seeded builder mixtures comprise: 3:1 wt. mixtures of sodium carbonate and calcium carbonate having a 5 micron particle diameter; 2.7:1 wt. mixtures of sodium sequicarbonate and calcium carbonate having a particle diameter of 0.5 microns; 20:1 wt. mixtures of sodium sequicarbonate and calcium hydroxide having a particle diameter of 0.01 micron; and a 3:3:1 wt. mixture of sodium carbonate, sodium aluminate and calcium oxide having a particle diameter of 5 microns.

A further class of detergency builder materials useful in the present invention are insoluble sodium aluminosilicates, particularly those disclosed in Belgian Pat. No. 814,874 issued Nov. 12, 1974 and incorporated herein by reference. This patent discloses detergent compositions containing sodium aluminosilicates of the formula $$Na_z(AlO_2)_z(SiO_2)_y xH_2O$$

wherein z and y are integers of at least 6, the molar ratio of z to y is in the range from 1.0:1 to about 0.5:1 and x is an integer from about 15 to about 264, said aluminosilicates having a calcium ion exchange capacity of at least 200 mg. eq./gr. and a calcium ion exchange rate of at least about 2 grains/gallon/minute/gram. A preferred material is $Na_{12}(SiO_2.AlO_2)_{12}.27\ H_2O$. Aluminosilicates for use herein include the amorphous and crystalline aluminosilicates disclosed in the pending U.S. Patent Application of Rodriguez, et al., Ser. No. 049,704, filed June 18, 1979, incorporated herein by reference. Particularly useful aluminosilicates are those commonly known as Zeolites A, X, and P(B).

The detergent compositions herein preferably have an in-use pH in an aqueous laundry liquor of from about 9.0 to about 11.0, more preferably from about 9.4 to about 10.4. This pH is preferably provided by alkali metal silicate builder materials. The alkali metal silicates also enhance particulate soil removal from laundered fabrics when included in the detergent compositions of this invention. Moreover, the silicates provide corrosion inhibition protection to the metal parts of washing machines. Finally, the silicates provide a certain degree of crispness and pourability to spray-dried detergent granules which is very desirable to avoid lumping and caking, particularly during prolonged storage.

The alkali metal silicates should represent from about 1% to about 15%, preferably from about 3% to about 8%, by weight of the detergent composition. The use of more than 10% by weight of the silicates in the spray-dried detergent compositions herein may present solubility problems in cold water usage conditions, especially when sodium aluminosilicate builders are also present in the detergent composition. (See U.S. Pat. No. 3,985,669, Krummel, et al., issued Oct. 12, 1976.) Admixing powdered alkali metal silicates with spray-dried granular compositions containing the aluminosilicates helps reduce interactions between the silicates and aluminosilicates and thus helps improve the solubility of granular detergents containing both components.

Suitable silicate solids have a molar ratio of $SiO_2$ to alkali metal oxide in the range from about 1:2 to about 4:1, preferably from about 1.6:1 to about 2.4:1. The alkali metal silicates suitable herein are commercial preparations of the combination of silicon dioxide and alkali metal oxide, fused together in varying proportions. Crystalline silicate solids normally possess a high alkalinity content; in addition hydration water is frequently present as, for example, in metasilicates which can exist having 5, 6 or 9 molecules of water. The alkalinity is provided through the monovalent alkali metal ions such as, for example, sodium, potassium, lithium and mixtures thereof. The sodium and potassium silicate solids are generally used. Thus, the preferred alkali metal silicates herein have a molar ratio of $SiO_2$:$M_2O$ of from about 1:2 to about 2.5:1 wherein M is sodium or potassium or mixtures thereof. Particularly preferred are the sodium silicates having an $SiO_2$:$Na_2O$ ratio of from about 1.6:1 to about 2.4:1.

An especially preferred builder system, suitable for providing the preferred in-use pH range, comprises from about 3% to about 8% by weight of the detergent composition of sodium silicate having a molar ratio of from about 1.6:1 to about 2.4:1 and from about 10% to about 30% by weight of the detergent composition of sodium carbonate. Such a builder system provides reserve alkalinity without undesirably reducing cold water solubility of the composition.

Granular detergent compositions herein preferably contain from about 20% to about 70% by weight of a detergent builder material selected from the group consisting of alkali metal phosphates, polyphosphates, carbonates, polyhydroxysulfonates, silicates, carboxylates, polycarboxylates, and aluminosilicates. As disclosed above, water-soluble mixtures of sodium silicate and sodium carbonate are most preferred.

Liquid detergent compositions herein preferably contain the water-soluble detergency builders disclosed in the pending U.S. patent applications of Leikhim, et al., Ser. No. 083,907, and Kuzel, et al., Ser. No. 083,908. These builders are described in detail in the Leikhim, et al., application from page 6, line 21 to page 9, line 29. More particularly, the organic builders for use in liquid compositions are the polycarboxylates, polyacetates, aminopolycarboxylates and phosphonates. Inorganic builders suitable for use in the liquid compositions herein are the polyphosphates, and preferably the water-soluble pyrophosphates.

Other optional components for use in liquid compositions herein include those described in the above Leikhim, et al., application, particularly from page 11, line 14 to page 16, line 4.

A preferred optional component for use in granular detergent compositions herein is the kaolinite or bentonite clay described in U.S. Pat. No. 4,166,039, Wise, issued Aug. 28, 1979. The clay material provides a homogeneous, crutcher-stable surfactant/clay mixture useful for spray-drying detergent granules containing nonionic surfactants.

Other ingredients which are conventionally used in detergent compositions can be included in the detergent compositions of the present invention. These components include color speckles, bleaching agents and bleach activators, suds boosters or suds suppressors, anti-tarnish and anti-corrosion agents, soil suspending agents, soil release agents, dyes, fillers, optical brighteners, germicides, pH adjusting agents, non-builder alkalinity sources, hydrotropes, enzymes, enzyme-stabilizing agents, perfumes, and other optional detergent compounds.

The following non-limiting examples illustrate the detergent compositions and the methods for laundering fabrics encompassed by the present invention.

All percentages, parts, and ratios used herein are by weight unless otherwise specified.

EXAMPLE I

The following are spray-dried granular detergent compositions according to the present invention.

| Component | A | B | C | D |
|---|---|---|---|---|
| $C_{12-16}$ alkyl dimethylamine oxide | 5.0 | 5.0 | 8.0 | 5.0 |
| $C_{12-16}$ alcohol-5 moles ethylene oxide | 10.0 | 10.0 | 8.0 | — |
| $C_{12-13}$ alcohol-6.5 moles ethylene oxide | — | — | — | 10.0 |
| Sodium tripolyphosphate | 32.0 | 24.4 | 24.4 | 24.4 |
| Sodium aluminosilicate (hydrated Zeolite A, particle diameter 1–10 microns) | — | 18.0 | 18.0 | 18.0 |
| Sodium carbonate | 20.0 | 20.0 | 14.0 | 14.0 |
| Sodium sulfate | 9.3 | 6.0 | — | 6.0 |
| Sodium silicate (1.6 r) | 6.0 | — | 6.0 | 3.0 |
| Bentolite L clay* | 3.5 | 3.5 | 3.5 | 3.5 |
| Polyethylene glycol 6000 | 0.9 | 0.9 | 3.6 | 1.8 |
| Water and miscellaneous | | Balance to 100 | | |

*A calcium bentonite clay manufactured by Georgia Kaolin Co.

Composition A (a highly preferred composition herein) was produced by admixing all components except the polyethylene glycol in a crutcher to form a homogeneous crutcher mix. The mix was spray-dried at a temperature of about 205° C. in a 3.4 meter diameter tower. The polyethylene glycol was then admixed with the spray-dried granules to form the final detergent composition.

Composition A was added, at a level of about 1400 parts per million (ppm), to a standard top-loading automatic washing machine containing 95 liters of water at a temperature of about 16° C. and having a hardness of about 7 grains/gallon (2 moles $Ca^{++}$:1 mole $Mg^{++}$). A load of mixed fabrics was laundered in the resulting liquor, which had a pH of about 9.7, using the machine manufacturer's instructions. The fabrics were then rinsed and dried.

Composition A delivered cleaning in the 16° C. wash water fully equivalent to that provided by a commercially available spray-dried granular detergent composition when used in 38° C. wash water.

Compositions B, C and D are prepared and used in a manner similar to that described above, and deliver similar cleaning performance.

Substantially similar cleaning performance is obtained when, in Compositions A, B, C or D, the amine oxide surfactant is a $C_{12}$, $C_{13}$, or $C_{14}$ alkyl dimethylamine oxide, or mixtures thereof.

Substantially similar cleaning is obtained when, in the above compositions, the nonionic surfactant is a $C_{10}$ alcohol-4 moles ethylene oxide, $C_{12}$ alcohol-5 moles ethylene oxide, $C_{14}$ alcohol-6 moles ethylene oxide, or mixtures thereof.

Comparable results are also obtained when the weight ratio of nonionic surfactant to amine oxide surfactant in any of the above compositions is about 1:4, 1:3, 1:2, 1:1, 2:1, 3:1 or 4:1.

Substantially similar cleaning is obtained when the polyethylene glycol 6000 in any of the above compositions is replaced with polyethylene glycol having a molecular weight of about 2000, 4000, 5000, 7000, 9000, 10,000, or 15,000, and the polyethylene glycol is present in the detergent compositions at levels of about 0.7%, 1.1%, 1.5%, 2.0%, 2.5%, 3.0%, 3.5% or 4.0%.

EXAMPLE II

The following are stable liquid detergent compositions according to the present invention.

| Component | A | B | C | D |
|---|---|---|---|---|
| $C_{12-13}$ alcohol - 6.5 moles ethylene oxide | 11.5 | 11.5 | 11.5 | — |
| $C_{12-16}$ alcohol - 5 moles ethylene oxide | — | — | — | 10.0 |
| Dimethyl $C_{12-16}$ alkyl amine oxide | 6.7 | 6.7 | 6.7 | 5.0 |
| Sodium citrate | 10.0 | — | — | — |
| Sodium nitrilotriacetate | — | — | 12.5 | 5.0 |
| Potassium pyrophosphate | — | 12.0 | — | 10.0 |
| Potassium toluene sulfonate | 12.1 | — | — | — |
| Phosphate Ester (Witco PS-413) | — | 12.0 | — | — |
| Sodium dioctyl sulfosuccinate | — | — | 5.0 | 6.0 |
| Monoethanolamine | 4.0 | 3.0 | 3.0 | 3.0 |
| Ethanol | 2.0 | 2.0 | 0.5 | 0.5 |
| Polyethylene glycol 6000 | 0.9 | 1.8 | 1.8 | 0.9 |
| Miscellaneous | 1.0 | 1.0 | 1.0 | 1.0 |
| Water | | Balance to 100 | | |

Compositions A and B are stable isotropic liquids formed by mixing the components. The isotropic form is spontaneous and is not dependent on the order of addition of the components.

Compositions C and D are prepared by mixing the ethoxylated nonionic surfactant with the hydrophobic emulsifier (sodium dioctyl sulfosuccinate) and adding the remaining components under high shear mixing. Stable water-in-oil emulsions are formed.

The compositions deliver similar cleaning performance under the conditions of usage described in Example I.

Substantially similar cleaning performance is obtained when, in Compositions A, B, C or D, the amine oxide surfactant is a $C_{12}$, $C_{13}$, or $C_{14}$ alkyl dimethylamine oxide, or mixtures thereof.

Substantially similar cleaning is obtained when, in the above compositions, the nonionic surfactant is a $C_{10}$ alcohol-4 moles ethylene oxide, $C_{12}$ alcohol-5 moles ethylene oxide, $C_{14}$ alcohol-6 moles ethylene oxide, or mixtures thereof.

Comparable results are also obtained when the weight ratio of nonionic surfactant to amine oxide surfactant in any of the above compositions is about 1:4, 1:3, 1:2, 1:1, 2:1, 3:1 or 4:1.

Substantially similar cleaning is obtained when the polyethylene glycol 6000 in any of the above compositions is replaced with polyethylene glycol having a molecular weight of about 2000, 4000, 5000, 7000, 9000, 10,000, or 15,000, and the polyethylene glycol is present in the detergent compositions at levels of about 0.7%, 1.1%, 1.5%, 2.0%, 2.5%, 3.0%, 3.5% or 4.0%.

While the compositions of the present invention, and especially those disclosed in Examples I and II, are especially useful in cold or cool water laundering operations, they may, of course, be effectively used in warm or hot water according to the desires of the user. The compositions have special cleaning advantages in removing particulate and oily soils and stains, such as those found on polycotton pillowcase fabrics.

What is claimed is:

1. A detergent composition especially useful for cold-water fabric laundering, comprising:

(a) from about 1% to about 20% by weight of an amine oxide surfactant of the formula

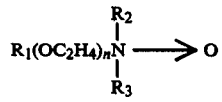

wherein $R_1$ is a $C_{10}$–$C_{18}$ hydrocarbyl or substituted hydrocarbyl lipophilic group, $R_2$ and $R_3$ are each $C_1$–$C_3$ hydrocarbyl or substituted hydrocarbyl groups, and n is from 0 to about 10;

(b) from about 1% to about 25% by weight of an ethoxylated alcohol or ethoxylated alkyl phenol nonionic surfactant of the formula $R(OC_2H_4)_nOH$ wherein R is selected from the group consisting of aliphatic hydrocarbyl groups containing from about 8 to about 18 carbon atoms, alkyl phenyl groups wherein the alkyl group contains from about 8 to about 15 carbon atoms, and mixtures thereof, and n is from about 3 to about 9; and (c) from about 0.1% to about 9% by weight of a polyethylene glycol having an average molecular weight of from about 2,000 to about 40,000.

2. A composition according to claim 1 wherein the amine oxide surfactant is a $C_{12}$–$C_{14}$ alkyl dimethylamine oxide.

3. A composition according to claim 2 wherein the amine oxide surfactant is $C_{12}$ alkyl dimethylamine oxide.

4. A composition according to claim 1 wherein the nonionic surfactant is an ethoxylated alcohol in which R contains from about 10 to about 14 carbon atoms and n is from about 4 to about 6.

5. A composition according to claim 4 wherein R contains about 12 carbon atoms and n is about 5.

6. A composition according to claim 4 wherein the amine oxide surfactant is a $C_{12}$–$C_{14}$ alkyl dimethylamine oxide.

7. A composition according to claim 6 wherein the amine oxide surfactant is $C_{12}$ alkyl dimethylamine oxide, and, in the ethoxylated alcohol nonionic surfactant, R contains about 12 carbon atoms and n is about 5.

8. A composition according to claim 1 wherein the amine oxide surfactant represents from about 3% to about 8% by weight of the detergent composition.

9. A composition according to claim 8 wherein the nonionic surfactant represents from about 5% to about 15% by weight of the detergent composition.

10. A composition according to claim 9 wherein the amine oxide surfactant is a $C_{12}$–$C_{14}$ alkyl dimethylamine oxide and the nonionic surfactant is an ethoxylated alcohol in which R contains from about 10 to about 14 carbon atoms and n is from about 4 to about 6.

11. A composition according to claim 10 wherein the amine oxide surfactant is $C_{12}$ alkyl dimethylamine oxide, and, in the ethoxylated alcohol nonionic surfactant, R contains about 12 carbon atoms and n is about 5.

12. A composition according to claim 11 wherein the weight ratio of nonionic surfactant to amine oxide surfactant is from about 1:1 to about 2:1.

13. A composition according to claims 1 or 10 wherein the polyethylene glycol has a molecular weight from about 2500 to about 20,000; and represents from about 0.5% to about 6% by weight of the detergent composition.

14. A composition according to claim 13 wherein the polyethylene glycol represents from about 0.9% to about 4% by weight of the detergent composition.

15. A composition according to claim 1 wherein the amine oxide surfactant represents from about 3% to about 8% by weight of the detergent composition and is a $C_{12}$–$C_{14}$ alkyl dimethylamine oxide; the nonionic surfactant represents from about 5% to about 15% by weight of the detergent composition and is an ethoxylated alcohol in which R contains from about 10 to about 14 carbon atoms and n is from about 4 to about 6; and the polyethylene glycol represents from about 0.9% to about 4% by weight of the detergent composition and has a molecular weight of from about 3000 to about 9000.

16. A composition according to claim 15 wherein the amine oxide surfactant is $C_{12}$ alkyl dimethylamine oxide, and, in the ethoxylated alcohol nonionic surfactant, R contains about 12 carbon atoms and n is about 5.

17. A composition according to claim 16 wherein the polyethylene glycol has a molecular weight of about 6000.

18. A composition of claims 1 or 15 which has an in-use pH in an aqueous laundry liquor of from about 9.0 to about 11.0.

19. A built detergent composition especially useful for cold-water fabric laundering, comprising:

(a) from about 1% to about 20% by weight of an amine oxide surfactant of the formula

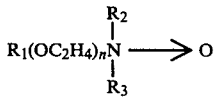

wherein $R_1$ is a $C_{10}$–$C_{18}$ hydrocarbyl or substituted hydrocarbyl lipophilic group, $R_2$ and $R_3$ are each $C_1$–$C_3$ hydrocarbyl or substituted hydrocarbyl groups, and n is from 0 to about 10;

(b) from about 1% to about 25% by weight of an ethoxylated alcohol or ethoxylated alkyl phenol nonionic surfactant of the formula $$R(OC_2H_4)_nOH$$

wherein R is selected from the group consisting of aliphatic hydrocarbyl groups containing from about 8 to about 18 carbon atoms, alkyl phenyl groups wherein the alkyl group contains from about 8 to about 15 carbon atoms, and mixtures thereof; and n is from about 3 to about 9;

(c) from about 0.1% to about 9% by weight of a polyethylene glycol having an average molecular weight of from about 2,000 to about 40,000 and (d) from about 5% to about 80% by weight of a detergent builder material.

20. A composition according to claim 19 which has an in-use pH in an aqueous laundry liquor of from about 9.0 to about 11.0.

21. A composition according to claim 20 which has an in-use pH in an aqueous laundry liquor of from about 9.4 to about 10.4.

22. A liquid detergent composition according to claim 20 wherein the detergent builder material is selected from the group consisting of water-soluble polycarboxylates, polyacetates, phosphonates, pyrophosphates, alkali metal silicates, and mixtures thereof, and represents from about 5% to about 25% by weight of the detergent composition.

23. A composition according to claim 22 wherein the detergent builder comprises an alkali metal silicate having a molar ratio of $SiO_2$:$M_2O$ of from about 1:2 to about 2.5:1, wherein M is sodium or potassium or mixtures thereof, said silicate representing from about 1% to about 15% by weight of the detergent composition.

24. A composition according to claim 23 wherein the alkali metal silicate is sodium silicate having a molar ratio of from about 1.6:1 to about 2.4:1, and represents from about 3% to about 8% by weight of the detergent composition.

25. A composition according to claims 22 or 24 wherein the amine oxide surfactant represents from about 3% to about 8% by weight of the detergent composition and is a $C_{12}$–$C_{14}$ alkyl dimethylamine oxide; the nonionic surfactant represents from about 5% to about 15% by weight of the detergent composition and is an ethoxylated alcohol in which R contains from about 10 to about 14 carbon atoms and n is from about 4 to about 6; and the polyethylene glycol represents from about 0.9% to about 4% by weight of the detergent composition and has a molecular weight of from about 3000 to about 9000.

26. A granular detergent composition according to claim 19 wherein the detergent builder material is selected from the group consisting of alkali metal phosphates, polyphosphates, carbonates, polyhydroxysulfonates, silicates, carboxylates, polycarboxylates, and aluminosilicates, and represents from about 20% to about 70% by weight of the detergent composition.

27. A composition according to claim 26 wherein the detergent builder material comprises an alkali metal silicate having a molar ratio of $SiO_2$:$M_2O$ of from about 1:2 to about 2.5:1, and wherein M is sodium or potassium, or mixtures thereof, said silicate representing from about 1% to about 15% by weight of the detergent composition.

28. A composition according to claim 27 wherein the alkali metal silicate is sodium silicate having a molar ratio of $SiO_2$:$Na_2O$ of from about 1.6:1 to about 2.4:1, and represents from about 3% to about 8% by weight of the detergent composition.

29. A composition according to claim 28 wherein the detergent builder material further comprises from about 10% to about 30% by weight of the detergent composition of sodium carbonate.

30. A composition according to claims 26 or 29 which has an in-use pH in an aqueous laundry liquor of from about 9.0 to about 11.0.

31. A composition according to claim 30 which has an in-use pH in an aqueous laundry liquor of from about 9.4 to about 10.4.

32. A composition according to claim 30 wherein the amine oxide surfactant represents from about 3% to about 8% by weight of the detergent composition and is a $C_{12}$–$C_{14}$ alkyl dimethylamine oxide; the nonionic surfactant represents from about 5% to about 15% by weight of the detergent composition and is an ethoxylated alcohol in which R contains from about 10 to about 14 carbon atoms and n is from about 4 to about 6; and the polyethylene glycol represents from about 0.9% to about 4% by weight of the detergent composition and has a molecular weight of from about 3000 to about 9000.

33. A composition according to claims 1 or 26 wherein the polyethylene glycol is admixed with detergent granules formed by spray-drying an aqueous slurry of the other components.

34. A composition according to claim 33 wherein the amine oxide surfactant represents from about 3% to about 8% by weight of the detergent composition and is a $C_{12}$–$C_{14}$ alkyl dimethylamine oxide; the nonionic surfactant represents from about 5% to about 15% by weight of the detergent composition and is an ethoxylated alcohol in which R contains from about 10 to about 14 carbon atoms and n is from about 4 to about 6; and the polyethylene glycol represents from about 0.9% to about 4% by weight of the detergent composition and has a molecular weight of from about 3000 to about 9000.

35. A process for laundering fabrics in cool or cold water comprising contacting said fabrics with an aqueous washing medium having a pH of from about 9.0 to about 11.0 and containing an effective amount of a detergent composition comprising:

(a) from about 1% to about 20% by weight of an amine oxide surfactant of the formula

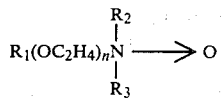

wherein $R_1$ is a $C_{10}$–$C_{18}$ hydrocarbyl or substituted hydrocarbyl lipophilic group, $R_2$ and $R_3$ are each $C_1$–$C_3$ hydrocarbyl or substituted hydrocarbyl groups, and n is from 0 to about 10;

(b) from about 1% to about 25% by weight of an ethoxylated alcohol or ethoxylated alkyl phenol nonionic surfactant of the formula $$R(OC_2H_4)_nOH$$

wherein R is selected from the group consisting of aliphatic hydrocarbyl groups containing from about 8 to about 18 carbon atoms, alkyl phenyl groups wherein the alkyl group contains from about 8 to about 15 carbon atoms, and mixtures thereof, and n is from about 3 to about 9; and (c) from about 0.1% to about 9% by weight of a polyethylene glycol having an average molecular weight of from about 2,000 to about 40,000.

36. A process according to claim 35 wherein the amine oxide surfactant represents from about 3% to about 8% by weight of the detergent composition and is a $C_{12}$–$C_{14}$ alkyl dimethylamine oxide; the nonionic surfactant represents from about 5% to about 15% by weight of the detergent composition and is an ethoxylated alcohol in which R contains from about 10 to about 14 carbon atoms and n is from about 4 to about 6; and the polyethylene glycol represents from about 0.9% to about 4% by weight of the detergent composition and has a molecular weight of from about 3000 to about 9000.

37. A process according to claim 36 wherein the detergent composition further comprises from about 3% to about 8% by weight of sodium silicate having a molar ratio of $SiO_2$:$Na_2O$ of from about 1.6:1 to about 2.4:1.

* * * * *

UNITED STATES PATENT AND TRADEMARK OFFICE

CERTIFICATE OF CORRECTION

PATENT NO. : 4,276,205

DATED : June 30, 1981

INVENTOR(S) : Merle W. Ferry

It is certified that error appears in the above-identified patent and that said Letters Patent are hereby corrected as shown below:

Column 2, line 41, "$C_1$-$C_2$" should read -- $C_1$-$C_3$ --.

Column 4, line 66, "anionic" should read -- nonionic --.

Column 14, line 16, "Claim 20" should read -- Claim 19 --.

Signed and Sealed this

*Twentieth* Day of *October 1981*

[SEAL]

*Attest:*

GERALD J. MOSSINGHOFF

*Attesting Officer* *Commissioner of Patents and Trademarks*